US008647020B2

(12) United States Patent
Stankus et al.

(10) Patent No.: US 8,647,020 B2
(45) Date of Patent: Feb. 11, 2014

(54) PLASTIC CABLE BOLT BUTTON

(75) Inventors: John C. Stankus, Canonsburg, PA (US); Dakota Faulkner, New Kensington, PA (US); John Feyrer, Sewickley, PA (US); John G. Oldsen, Butler, PA (US); Jeffrey J. Stankus, Canonsburg, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 20 days.

(21) Appl. No.: 13/008,095

(22) Filed: Jan. 18, 2011

(65) Prior Publication Data

US 2011/0200400 A1 Aug. 18, 2011

Related U.S. Application Data

(60) Provisional application No. 61/305,686, filed on Feb. 18, 2010.

(51) Int. Cl.
*E21D 20/02* (2006.01)

(52) U.S. Cl.
USPC ..... 405/259.6; 405/259.1; 405/302.2

(58) Field of Classification Search
USPC ..... 405/259.1, 259.5, 259.6, 302.2
See application file for complete search history.

(56) References Cited

U.S. PATENT DOCUMENTS 3,077,809 A * 2/1963 Harding et al. ..... 405/302.2
5,288,176 A * 2/1994 Huff et al. ..... 405/259.6
5,525,013 A * 6/1996 Seegmiller et al. ..... 405/302.2
5,556,233 A * 9/1996 Kovago ..... 405/302.2
5,584,608 A * 12/1996 Gillespie ..... 405/259.6
5,624,212 A * 4/1997 Gillespie ..... 405/302.2
5,829,922 A 11/1998 Calandra, Jr. et al.
5,919,006 A 7/1999 Calandra, Jr. et al.
5,931,064 A * 8/1999 Gillespie ..... 405/259.1
6,056,482 A 5/2000 Calandra, Jr. et al.
6,074,134 A 6/2000 Stankus et al.
6,270,290 B1 8/2001 Stankus et al.
6,322,290 B1 11/2001 Calandra, Jr. et al.
6,402,433 B1 * 6/2002 Gillespie ..... 405/259.1
6,428,243 B1 * 8/2002 Hutchins ..... 405/259.1
6,527,482 B1 3/2003 Stankus
6,612,783 B2 * 9/2003 Stankus et al. ..... 405/259.5
6,622,783 B2 9/2003 Hitt et al.
2009/0041550 A1 * 2/2009 Oldsen et al. ..... 405/259.6
2009/0067932 A1 * 3/2009 Fox ..... 405/302.2

* cited by examiner

*Primary Examiner* — Frederick L Lagman
(74) *Attorney, Agent, or Firm* — The Webb Law Firm

(57) ABSTRACT

A cable bolt button comprising a continuous sidewall having a first end, a second end and an end portion attached to the first end of the sidewall, forming an inner cavity. The cable bolt button forms an interference fit between the sidewall of the cable bolt button and a cable bolt when the button is placed over the distal end of the cable bolt. The cable bolt button may also include a plurality of protrusions extending outwardly from the end portion away from the inner cavity and/or at least one recess. The protrusions may be separate features of the end portion or the first end of the sidewall may have a non-linear profile with the periphery of the end portion following the profile of the sidewall to form the protrusions and recesses. The end portion may also comprise a plurality of intersecting surfaces further shaping the protrusions and recesses.

15 Claims, 11 Drawing Sheets

PLASTIC CABLE BOLT BUTTON

CROSS REFERENCE TO RELATED APPLICATIONS

This application claims priority from U.S. Provisional Patent Application No. 61/305,686, filed Feb. 18, 2010, which is incorporated herein by reference.

BACKGROUND OF THE INVENTION

1. Field of the Invention

The present invention relates to a cable bolt button used on the end of cable mine roof bolts, in particular, a cable bolt button adapted to prevent sliding of the button down the strands of the cable bolt, center the resin cartridge in the bore hole, aid in puncturing the resin cartridge, enhance mixing, and prevent finger gloving.

2. Description of Related Art

Cable mine roof bolts are installed by placing a resin cartridge, including catalyst and adhesive material, into the blind end of a bore hole, inserting the cable bolt into the bore hole so that the upper end of the cable bolt rips open the resin cartridge and the resin flows in the annulus between the bore hole and the cable bolt, rotating the cable bolt to mix the resin catalyst and adhesive and allowing the resin to set about the cable bolt. Typically, the resin may be set after two to three minutes. Once cured, the adhesive helps to anchor the cable segment to the earth and rock.

Cable bolts are the subject of U.S. Pat. Nos. 5,829,922, 5,919,006, 6,074,134, 6,056,482, 6,622,783, 6,527,482, 6,322,290, and 6,270,290, herein incorporated by reference. A button may be placed at the end of the cable bolt to hold the individual strands of the cable together and assist in puncturing the resin cartridge and mixing of the resin when the bolt may be inserted into the bore hole.

Conventional cable bolt buttons have several inadequacies. Conventional buttons are metal sleeves crimped or swaged onto the end of the cable that do not have an end portion covering the distal end of the central strand of the cable bolt. This allows the button to, at times, slide down the strands when the cable bolt is inserted into the bore hole. The conventional buttons have no feature to aid in centering the cartridge with the cable bolt. The conventional buttons are also prone to finger gloving. Finger gloving occurs when the end portion of the punctured resin cartridge becomes attached to the sides of the cable bolt and prevents the resin from directly adhering to the bolt.

SUMMARY OF THE INVENTION

The cable bolt button of the present invention overcomes many of the deficiencies of conventional cable bolt buttons. The cable bolt button comprises a continuous sidewall having a first end and a second end. An end portion may be attached about its periphery to the first end of the sidewall, closing that end and forming an inner recess. The cable bolt button forms an interference fit between the sidewall of the cable bolt button and a cable bolt when the button is placed over the distal end of the cable bolt.

The cable bolt button may also include a plurality of protrusions extending outwardly from the end portion away from the inner cavity and/or at least one cavity. The protrusions may be separate features attached to the end portion. Alternatively, the first end of the sidewall may have a non-linear profile where the periphery of the end portion follows the profile of the first end of the sidewall to form protrusions and cavities. The end portion may also comprise a plurality of intersecting surfaces further shaping the protrusions and cavities.

These protrusions and cavities serve many functions including centering the cable bolt with the resin cartridge, assisting in ripping open the resin cartridge and mixing the resin, and reducing finger gloving.

DETAILED DESCRIPTION OF THE INVENTION

Figure 1A:
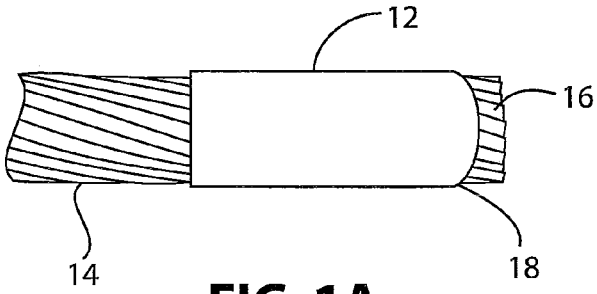
FIG. 1A PRIOR ART
FIG. 1A is a perspective view of a conventional cable bolt button.
Figure 1B:
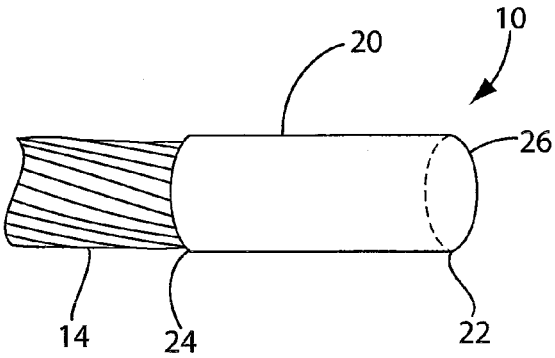
FIG. 1B is a perspective view of one embodiment of a cable bolt button according to the present invention.
Figure 1C:
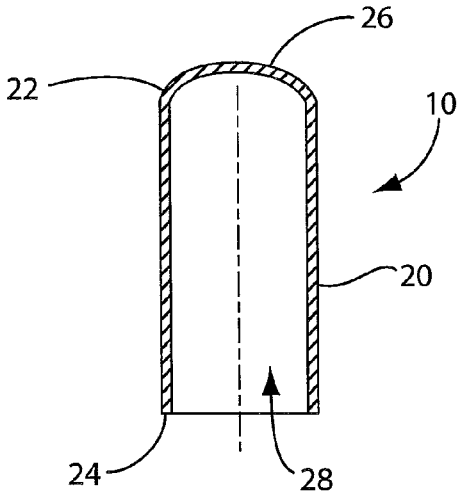
FIG. 1C is a cross-sectional view of the cable bolt button shown in FIG. 1B.

A prior art cable bolt button is shown in FIG. 1A and one embodiment of a cable bolt button 10, according to the present invention, is shown in FIGS. 1B and 1C. The prior art cable bolt button comprises a metal conduit 12 crimped around the cable bolt 14. The distal end 16 of the cable bolt 14 may be exposed and extends beyond the end 18 of metal conduit 12.

The cable bolt button 10 of the present invention comprises a cylindrical continuous sidewall 20 having a first end 22 and a second end 24 and an end portion 26. The end portion 26 is attached about its periphery to, or is continuous with the first end 22 of the continuous sidewall 20, thereby creating an inner cavity 28. The end portion 26 may have a generally convex shape. The end portion 26 may be formed integrally with the sidewall 20 using a molding process or other suitable technique, or may be bonded to the sidewall 20 using adhesive or any other suitable method. In use, the distal end 16 of the cable bolt 14 is received within the inner cavity 28. The cable bolt button 10 forms an interference fit between an interior surface of the sidewall 20 of the cable bolt button 10 and the cable bolt 14. The inner cavity 28 may be about 0.5"-0.7" in diameter. The end portion 26 prevents the cable bolt button 10 from sliding down the cable bolt 14 when the distal end 16 of the cable bolt 14 is inserted into a bore hole. The end portion 26 may be continuous and fully enclose the first end 22 or may be discontinuous (having opening(s) therethrough) yet still prevent distal end 16 of cable bolt 14 from passing first end 22 of cable bolt button 10.

The sidewall 20 of the cable bolt button 10 generally extends a sufficient distance along the cable bolt 14 to contain all of the individual strands of the cable bolt 14 and create a tight interference fit between the sidewall 20 and the cable bolt 14. The sidewall may be about 1.5" in length or more.

While cable bolt button 10 has a sidewall 20 with a circular cross-section and a circular, convex end portion 26, these parameters may be varied. The cross-section of sidewall 20 may have any shape as long as the sidewall 20 of the cable bolt button and the cable bolt 14 fit together when the cable bolt button is placed on the distal end 16 of the cable bolt 14.

The end portion 26 may be attached such that its periphery is flush with the sidewall 20 as shown in FIGS. 1B and 1C or may extend beyond the sidewall 20 (not shown). Where the end portion 26 is flush with the sidewall 20, the end portion 26 may take a shape corresponding to the shape of the cross-section of the sidewall 20 in order to close the first end of the sidewall 20. Where the end portion 26 extends beyond the sidewall 20, it may take any shape. The end portion 26 may also be flat, convex, concave, or as described later, may comprise a plurality of intersecting surfaces that form protrusions and recesses.

Figure 2:
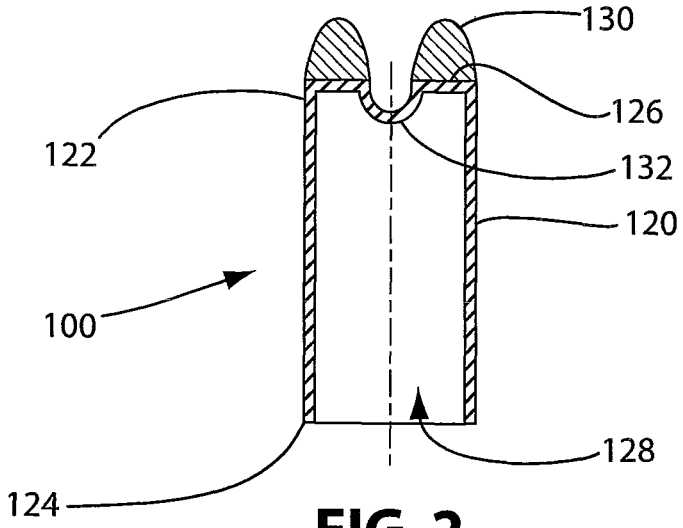
FIG. 2 is a cross-sectional view of a second embodiment of a cable bolt button according to the present invention having protrusions and a cavity.

As shown in FIG. 2, in another embodiment, cable bolt button 100 includes an end portion 126 having at least one protrusion 130 extending outwardly away from an inner cavity 128. The protrusions 130 may be integral with the end portion 126 or may be attached to the end portion 126 using adhesive or any other suitable means. The protrusions 130 may be configured to receive an end of a resin cartridge and/or to align a resin cartridge on a cable bolt. The protrusions 130 may also assist in ripping open a resin cartridge and mixing the resin.

The end portion 126 may define at least one recess 132. The recess 132 may be defined in the center of the end portion 126 to receive an end of a resin cartridge and/or to center the cable bolt with the resin cartridge. However, any number of recesses may be used.

Figure 3:
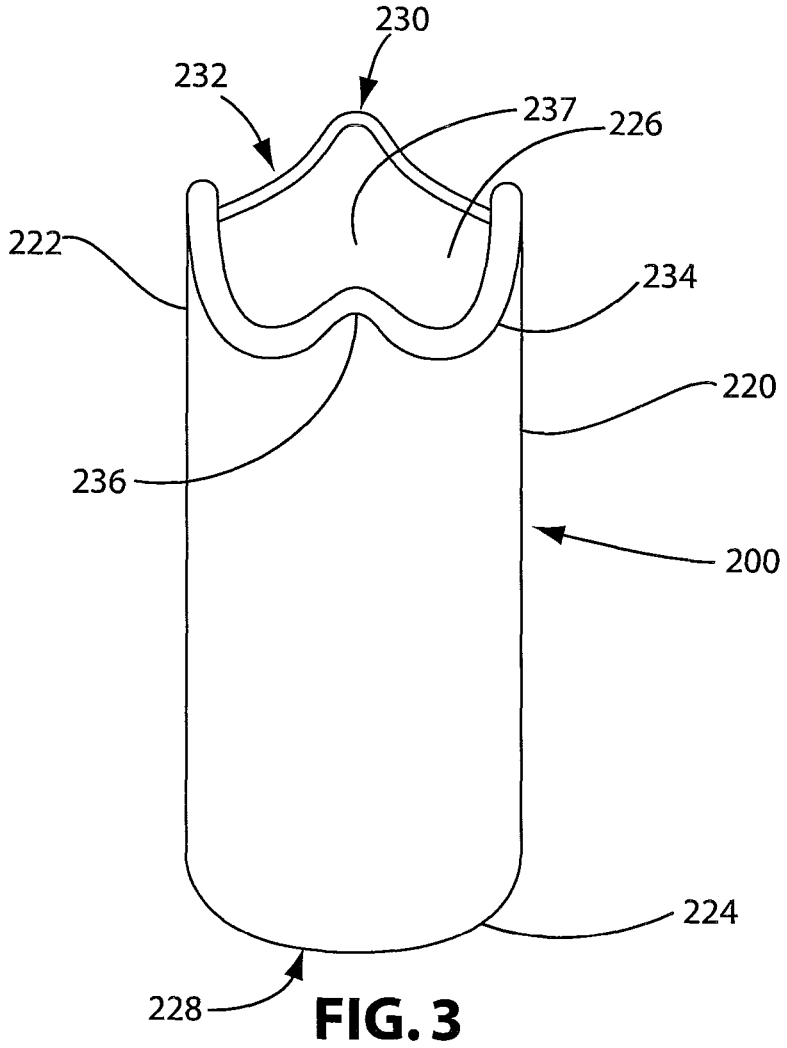
FIG. 3 is a perspective view of a third embodiment of a cable bolt button according to the present invention having a sidewall with a non-linear profile.

As shown in FIG. 3, in another embodiment, cable bolt button 200 includes a sidewall 220 with a first end 222 having a non-linear, scalloped profile with concave portions 234 and convex portions 236. An end portion 226 follows this profile, having a generally smooth concave shape sloping inwardly from the first end 222 of sidewall 220 such that the deepest portion 237 of the end portion 226 is at the center, with protrusions 230 and recesses 232 extending therebetween.

It should be appreciated that the protrusions and recesses formed in the end portion 226 of cable bolt button 200 may be further modified or increased in number. This may be achieved, for example, by defining a plurality of additional intersecting surfaces forming the contours of the protrusions 230 and recesses 232. These surfaces may be flat, convex, or concave.

Figure 4:
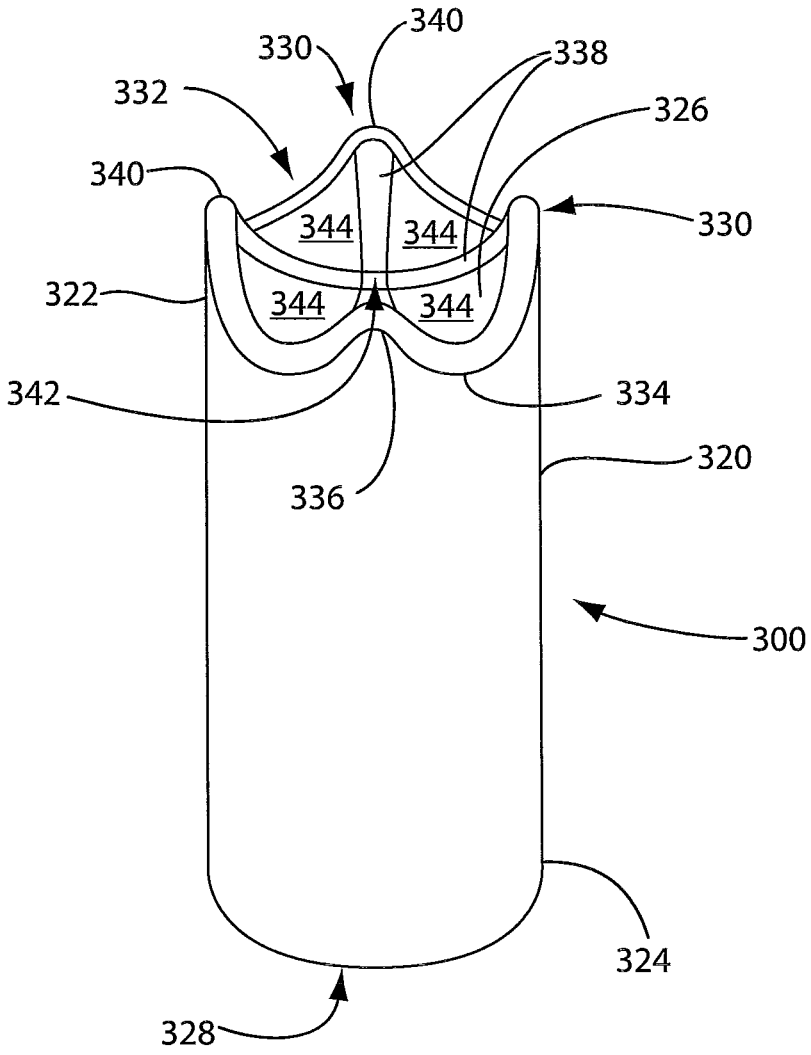
FIG. 4 is a perspective view of a fourth embodiment of a cable bolt button according to the present invention.

In one such embodiment, cable bolt button 300 (FIG. 4) includes ridges 338 extending from a top 340 of each protrusion 330 to a center region 342 of an end portion 326. Generally concave triangular-shaped surfaces 344 are bounded by first end 322 of sidewall 320 and ridges 338. It should be appreciated that the intersecting surfaces of end portion 326 may vary in size, shape, number, and orientation to further define the protrusions and recesses.

Figure 5A:
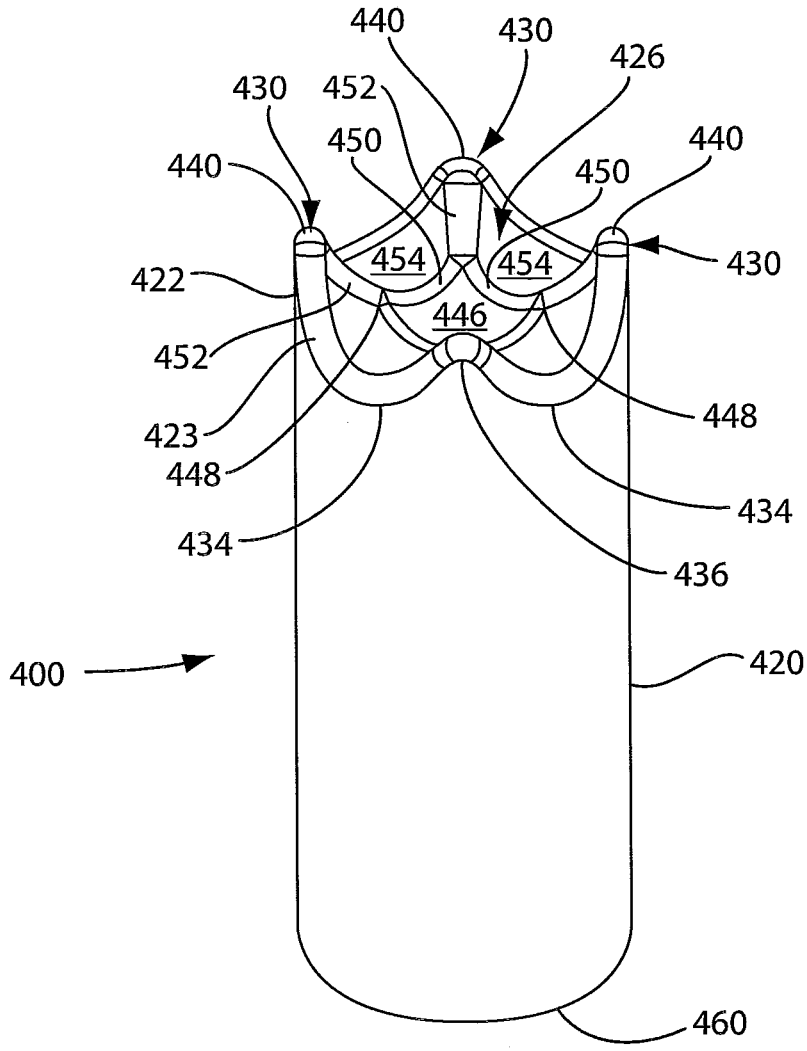
FIG. 5A is a perspective view of a fifth embodiment of cable bolt button according to the present invention.
Figure 5B:
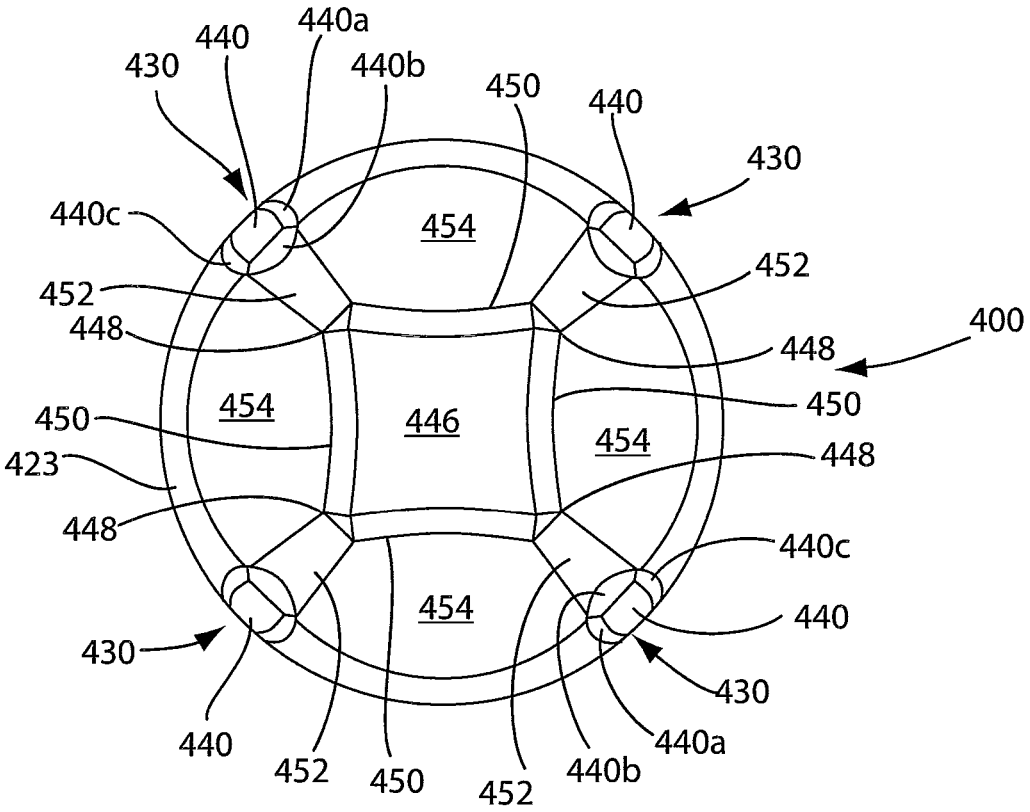
FIG. 5B is a top view of the cable bolt button shown in FIG. 5A.

In another embodiment, shown in FIGS. 5A and 5B, the cable bolt button 400 may have a distinct shape in order to center the cable bolt with the resin cartridge and assist in ripping open the resin cartridge and mixing the resin.

Cable bolt button 400 includes a sidewall 420 having a first end 422 that is scalloped with four concave portions 434 and four convex portions 436 bounded by edge surface 423. An end portion 426 follows the contour of the first end 422 of the sidewall 420, as in cable bolt buttons 200 and 300. End portion 426 includes a central concave surface 446. The central concave surface 446 may be four-sided and generally square-shaped. The central concave surface 446 is bound on all sides by inside lip portions 450 adjoined by corner portions 448.

Protrusions 430 are formed where the end portion 426 adjoins the convex portions 436 of the first end 422 of the sidewall 420. Each protrusion 430 has a top portion 440 and multiple side surfaces 440*a*, 440*b*, 440*c*. Side surfaces 440*a*, 440*b*, 440*c* may alternatively be a single surface or two or more surfaces. Corner portions 448 connect with protrusion 430 via surfaces 452, thereby defining surfaces 454.

The intersecting surfaces of cable bolt button 400 form five concave recesses 454 and 446 and four prong-shaped protrusions 430. The end portion 426 may be integral with one or more of the sidewall 420 and edge surface 423. One embodiment of cable bolt button 400 is about 1.5" in length as measured from an open second end 460 of the sidewall 420 to the bottom of the concave portion 434 and about 1.8" in length as measured from the open second end 460 of the sidewall 420 to the top of the convex portion 436.

Figure 6A:
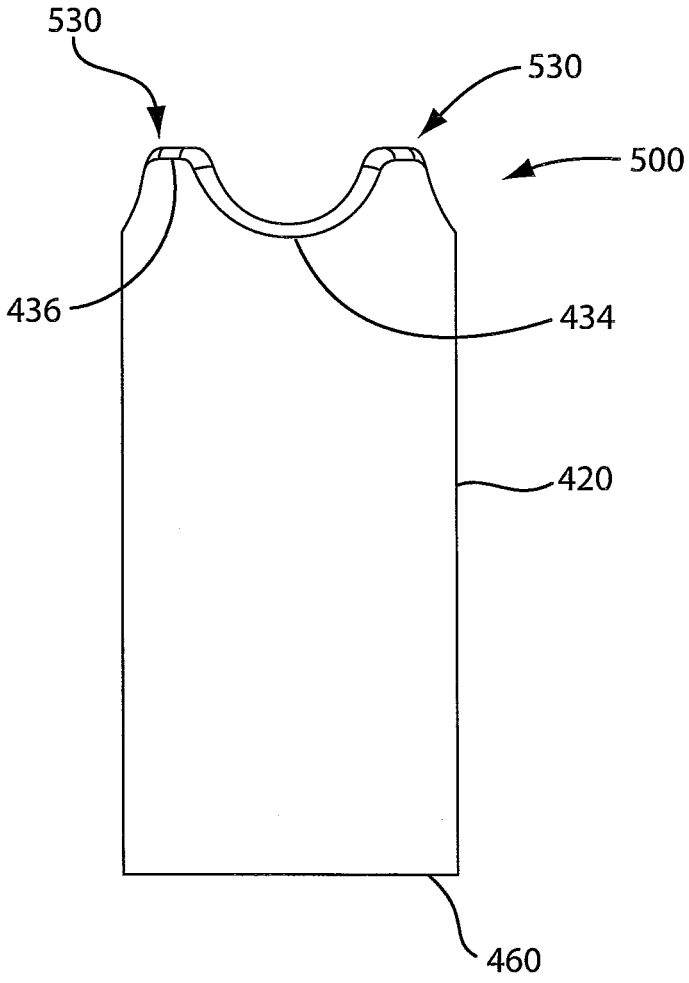
FIG. 6A is a side view of a sixth embodiment of a cable bolt button according to the present invention.
Figure 6B:
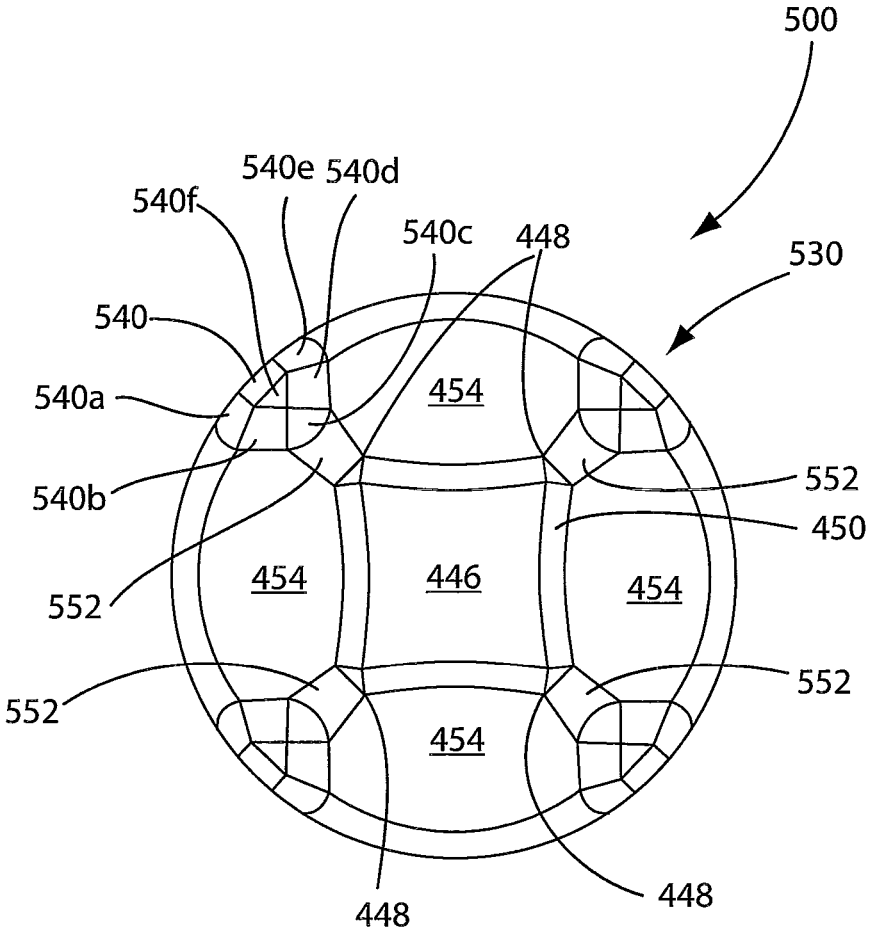
FIG. 6B is a top view of the cable bolt button shown in FIG. 6A.

In another embodiment, shown in FIGS. 6A and 6B, cable bolt button 500 is similar to cable bolt button 400, except as noted herein. Cable bolt button 500 includes protrusions 530 having top portion 540 and side surfaces 540*a*, 540*b*, 540*c*, 540*d*, 540*e*, and 540*f* connecting via surface 552 to corner portion 448.

Figure 7A:
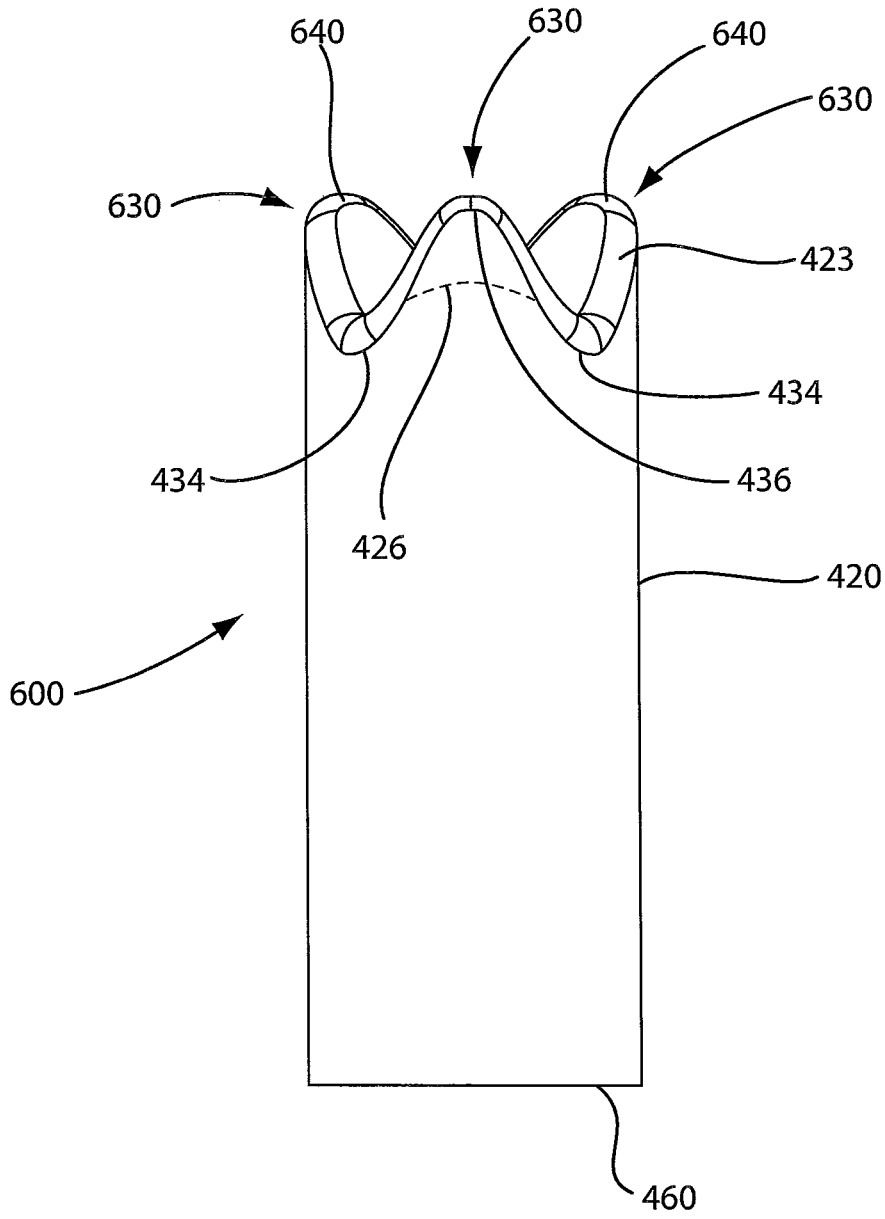
FIG. 7A is a side view of a seventh embodiment of a cable bolt button according to the present invention.
Figure 7B:
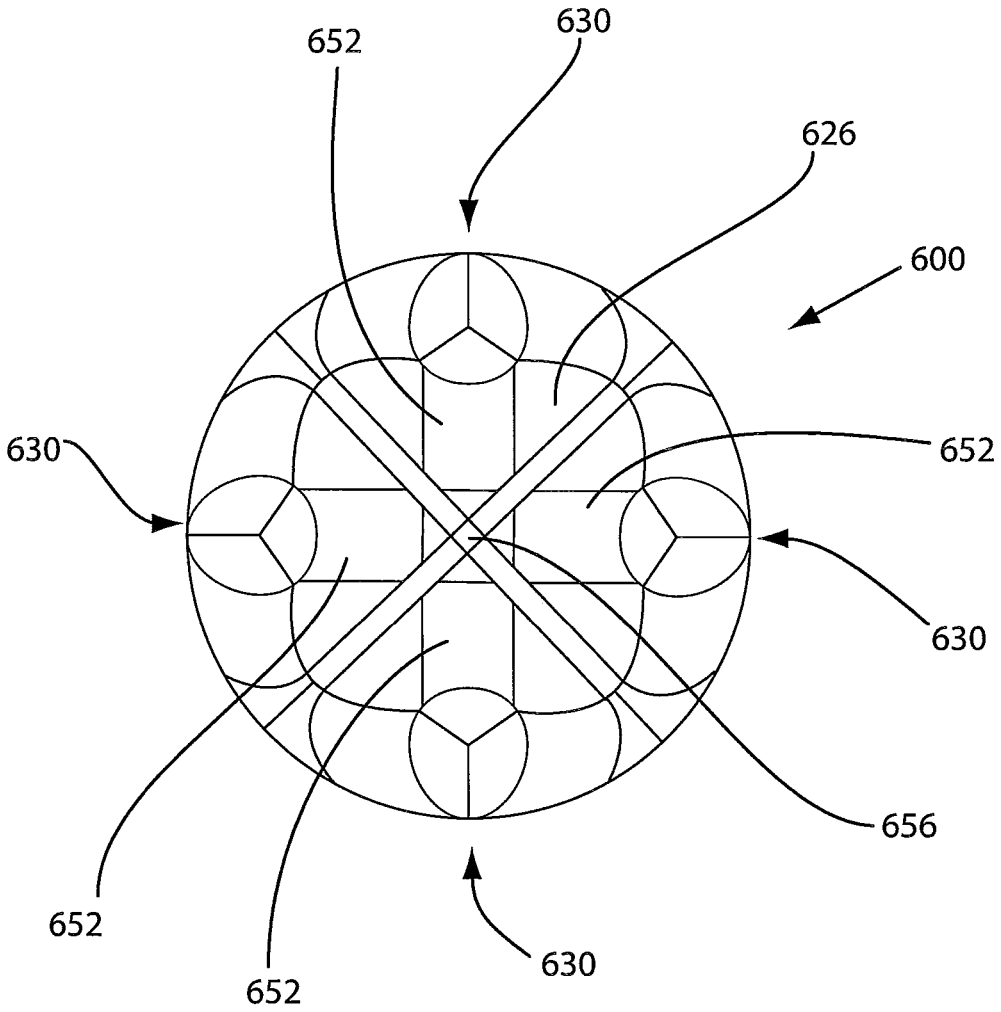
FIG. 7B is a top view of the cable bolt button shown in FIG. 7A.
Figure 7C:
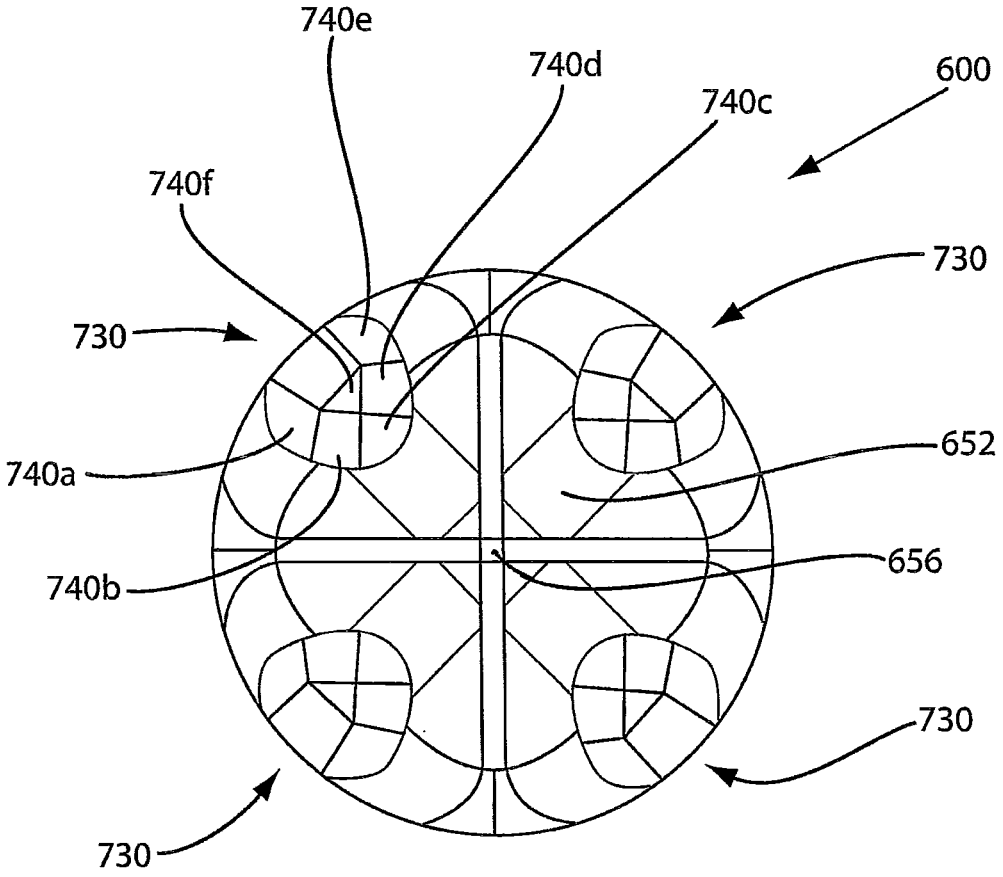
FIG. 7C is a top view of an eighth embodiment of a cable bolt button according to the present invention.

In yet another embodiment, shown in FIGS. 7A and 7B, cable bolt button 600 is similar to cable bolt button 400, except as noted herein. Protrusions 630 and edge surface 623 surround end portion 626. While end portion 426 of cable bolt button 400 is generally concave, end portion 626 is generally convex as shown in phantom in FIG. 7A. End portion 626 includes surfaces 652 extending from protrusions 630 and terminating at apex 656 which may be lower than top portions 640 of protrusions 630. Alternatively, as shown for cable bolt button 600' in FIG. 7C, protrusions 730 with multiple side surfaces 740*a*-740*f* (akin to side surfaces 540*a*-540*f* of protrusions 530 of cable bolt 500) may be included.

Figure 8:
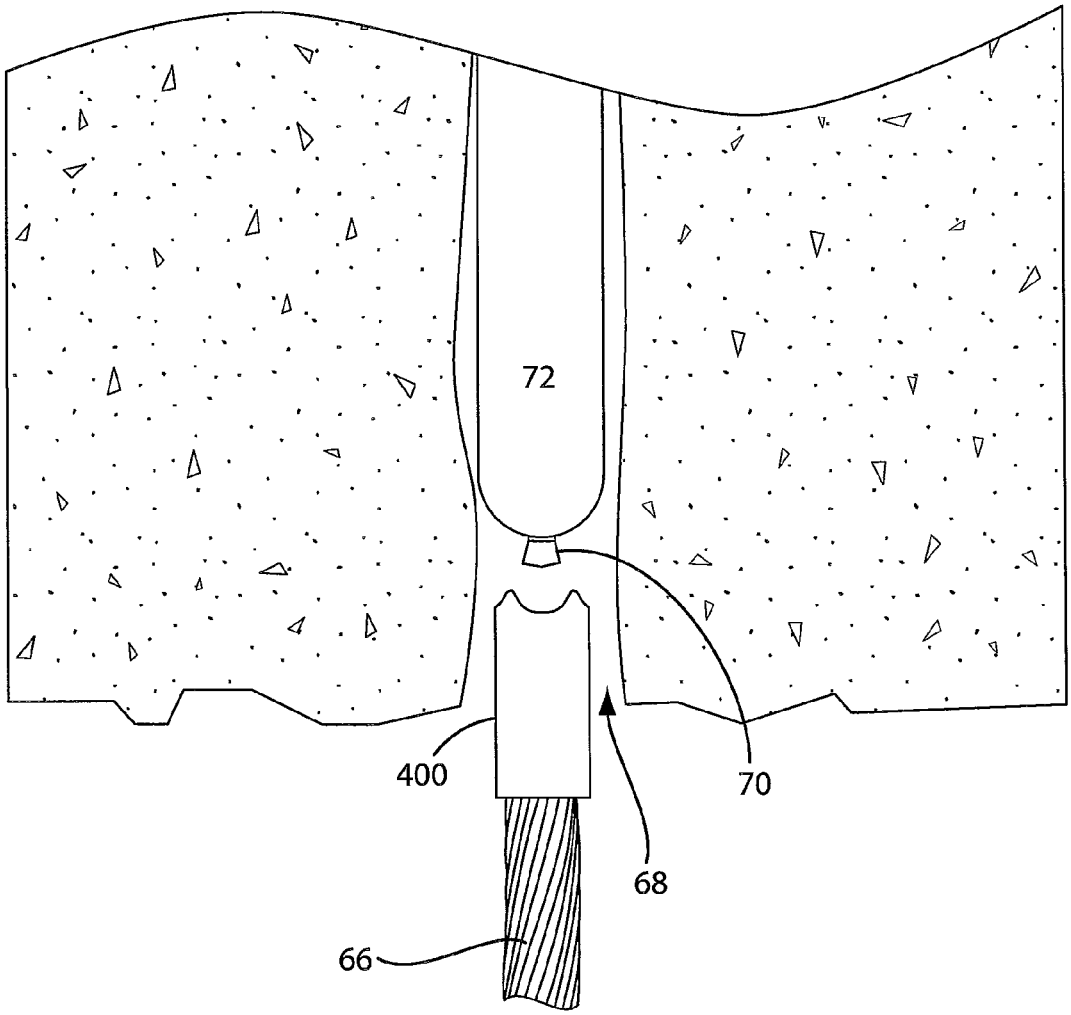
FIG. 8 is a cross-section view of a cable bolt button on a cable bolt engaging a resin cartridge in a bore hole.

FIG. 8 shows cable bolt button 400 installed on the distal end of a cable bolt 66 being inserted into bore hole 68 and illustrates how cable bolt button 400 engages the end closure 70 of the resin cartridge 72. This centers the cable bolt button 400 with the resin cartridge 72 which allows for more effective puncturing of the cartridge and mixing of the resin. It also reduces finger gloving. The protrusions and recesses in the cable bolt button 400 also contribute to more effective mixing of the resin. Cable bolt buttons 100, 200, 300, 500, 600, and 600' may also be used in a similar manner to achieve the same desirable results. The present invention may be used in place of conventional metal buttons, thereby providing cost savings in the production of cable bolts.

The cable bolt buttons, 100-600' may be made of plastic, such as a flexible, non-brittle plastic that can withstand insertion of the cable bolt into the bore hole without fracturing. One suitable material is poly vinyl chloride (PVC). Buttons 100-600' may be provided by molding or other conventional plastics processing techniques.

While the present invention has been described with reference to particular embodiments of a mine roof bolt and methods associated therewith, those skilled in the art may make modifications and alterations to the present invention without departing from the spirit and scope of the invention. Accordingly, the foregoing detailed description is intended to be illustrative rather than restrictive. The invention is defined by the appended claims, and all changes to the invention that fall within the meaning and the range of equivalency of the claims are embraced within their scope.

The invention claimed is:

1. A cable bolt button comprising:

a sidewall having a first end and a second end and an end portion connected to said sidewall at said first end;

said sidewall and end portion defining an inner cavity for receiving a distal end of a cable bolt;

wherein, there is an interference fit between said sidewall of said cable bolt button and said cable bolt when said cable bolt button is placed over said distal end of said cable bolt;

wherein said sidewall and said end portion of said cable bolt button are made of a flexible material;

wherein at least a portion of said end portion of said cable bolt button contacts an end of a resin cartridge when said cable bolt is placed in a mine bore; and wherein a portion of said first end of said sidewall of said cable bolt button extends outwardly away from the inner cavity relative to another portion of said first end of said sidewall.

2. The cable bolt button of claim 1, wherein the end portion completely closes the first end of the sidewall.

3. The cable bolt button of claim 1, wherein the end portion does not completely close the first end of the side wall, but sufficiently covers said distal end of said cable bolt when said cable bolt button is placed over said distal end of said cable bolt to keep said cable bolt button from sliding down said cable bolt.

4. The cable bolt button of claim 1, wherein the end portion is one of concave, convex, or flat.

5. The cable bolt button of claim 1, wherein the end portion further comprises a plurality of intersecting surfaces that form protrusions and recesses.

6. The cable bolt button of claim 5, wherein each surface is one of flat, concave, or convex.

7. The cable bolt button of claim 1 made of flexible plastic.

8. The cable bolt button of claim 1 made of poly vinyl chloride.

9. The cable bolt button of claim 1, wherein a profile of said first end of said sidewall is nonlinear and a periphery of said end portion follows said profile of said sidewall.

10. The cable bolt button of claim 9, wherein the profile of the sidewall is scalloped.

11. The cable bolt button of claim 9, wherein the end portion further comprises a plurality of intersecting surfaces that form protrusions and recesses.

12. The cable bolt button of claim 11, wherein each surface is one of flat, concave, or convex.

13. A cable bolt button comprising:

a sidewall having a first end and a second end and an end portion connected to said sidewall at said first end;

said sidewall and end portion defining an inner cavity for receiving a distal end of a cable bolt;

wherein, there is an interference fit between said sidewall of said cable bolt button and said cable bolt when said cable bolt button is placed over said distal end of said cable bolt;

wherein at least a portion of said end portion of said cable bolt button contacts an end of a resin cartridge when said cable bolt is placed in a mine bore; and wherein at least one protrusion extends from the end portion outwardly away from the inner cavity.

14. The cable bolt button of claim 13, wherein the end portion further comprises at least one recess.

15. A cable bolt button comprising:

a sidewall having a first end and a second end and an end portion connected to said sidewall at said first end;

said sidewall and end portion defining an inner cavity for receiving a distal end of a cable bolt;

wherein, there is an interference fit between said sidewall of said cable bolt button and said cable bolt when said cable bolt button is placed over said distal end of said cable bolt;

wherein said sidewall and said end portion of said cable bolt button are made of a flexible material;

wherein at least a portion of said end portion of said cable bolt button contacts an end of a resin cartridge when said cable bolt is placed in a mine bore; and wherein a portion of said end portion of said cable bolt button extends outwardly away from the inner cavity relative to a more centrally disposed portion of said end portion.

* * * * *